US011357375B2

(12) United States Patent
Cheng

(10) Patent No.: US 11,357,375 B2
(45) Date of Patent: Jun. 14, 2022

(54) DUST COLLECTING DEVICE WITH EXTENDIBLE AND FLEXIBLE AIR TUBE

(71) Applicant: RIGHTNOW CO., LTD, New Taipei (TW)

(72) Inventor: Kuo-Chang Cheng, New Taipei (TW)

(73) Assignee: RIGHTNOW CO., LTD, New Taipei (TW)

( * ) Notice: Subject to any disclaimer, the term of this patent is extended or adjusted under 35 U.S.C. 154(b) by 197 days.

(21) Appl. No.: 16/827,732

(22) Filed: Mar. 24, 2020

(65) Prior Publication Data

US 2021/0298551 A1 Sep. 30, 2021

(51) Int. Cl.

| | |
|---|---|
| ***A47L 9/24*** | (2006.01) |
| ***A47L 7/00*** | (2006.01) |
| ***A47L 9/28*** | (2006.01) |
| ***A47L 9/16*** | (2006.01) |

(52) U.S. Cl.

CPC ..... *A47L 9/244* (2013.01); *A47L 7/0095* (2013.01); *A47L 9/1608* (2013.01); *A47L 9/1683* (2013.01); *A47L 9/2868* (2013.01)

(58) Field of Classification Search

CPC ..... A47L 5/28; A47L 5/32; A47L 5/36–5/38; A47L 7/0047; A47L 7/0066; A47L 9/06–0693; A47L 9/10–9/1409; A47L 9/16–1691; A47L 9/19; A47L 9/24–248; A47L 7/76–95; A45D 29/00

USPC ..... 15/300.1, 301, 303, 312.1, 312.2, 314, 15/315

See application file for complete search history.

(56) References Cited

U.S. PATENT DOCUMENTS

| | | | | |
|---|---|---|---|---|
| 4,105,420 | A * | 8/1978 | Moore | A47L 9/00 15/339 |
| 5,513,417 | A * | 5/1996 | Kim | A47L 9/0081 15/326 |
| 9,277,844 | B1 * | 3/2016 | Millan | A47L 9/244 |
| 2005/0102790 | A1 * | 5/2005 | Matsuno | A47L 9/22 15/326 |
| 2007/0113375 | A1 * | 5/2007 | Battle | A47L 9/244 15/414 |
| 2020/0037837 | A1 * | 2/2020 | Hsieh | A45D 29/00 |

* cited by examiner

*Primary Examiner* — Anne M Kozak
*Assistant Examiner* — Christopher Soto
(74) *Attorney, Agent, or Firm* — Idea Intellectual Limited; Margaret A. Burke; Sam T. Yip

(57) ABSTRACT

A dust collecting device with an extendible and flexible air tube including a housing, a cover, an air tube, a dust collecting head, a filter material and a gas guiding device. The cover is detachably disposed on the housing and has an accommodating groove. The air tube is positioned in the accommodating groove and extendible and flexible, the air tube is capable of being extended to outside the accommodating groove and retracted to be accommodated in the accommodating groove, and a bending angle and an extension direction of the air tube is changeable by flexibility. The dust collecting head is disposed at the air tube, and is positioned in the accommodating groove when the air tube is shortened to be accommodated in the accommodating groove. The filter material is disposed inside the housing and close to the cover. The gas guiding device is disposed inside the housing.

14 Claims, 10 Drawing Sheets

DUST COLLECTING DEVICE WITH EXTENDIBLE AND FLEXIBLE AIR TUBE

BACKGROUND OF THE INVENTION

1. Field of the Invention

The present invention relates to a dust collecting device, and particularly to a dust collecting device used to collect nail dust and nail shavings and having an extendible and flexible air tube.

2. The Prior Arts

In the field of nail art, the nail must be polished to make the nail surface smoother or remove the original curable adhesive on the nail surface, users usually use various nail tools such as nail clippers, file, scissors, brushes, nail polisher to trim or grind nails. Users can further make fine nail art after the nail surface is smooth enough or the curable adhesive has been completely removed. After the nail art is completed, users also use nail polishers to trim nails.

During the process of nail polishing, some nail shavings and nail dust from the nails fall slowly, and some are thrown out quickly, causing a lot of nail shavings and nail dust to accumulate on the desktop and other spaces in the room and affect the respiratory health of users, explosion or fire resulting from dust is also dangerous. Therefore, users usually prepare a dust collection device to collect nail shavings and nail dust to make the environment clean.

The conventional dust collecting device is flat and has a housing, a filter material and an axial flow fan. The housing is disposed with an air inlet and an air outlet, the air inlet is upward, and the air outlet is downward. The filter material is set in the housing and located under the air inlet. The axial flow fan is located in the housing and located between the filter material and the air outlet. The axial fan guides the gas sequentially through the air inlet, the inside of the housing, the filter material, and guides the gas axially into the axial flow fan, and then guides the gas axially downward to the air outlet. The nail shavings and nail dust from the nails sequentially pass through the air inlet and the inside of the housing with the gas, and then be blocked by the filter material and concentrated on the surface of the filter material to achieve the effect of collecting nail shavings and nail dust.

However, the conventional dust collecting device can only inhale the nail chips and nail dust falling slowly during nail polishing without inhaling the nail chips and nail dust that quickly thrown out during nail polishing. The dust collection efficiency is only 50%, the other 50% of the nail dust and nail dust is thrown around.

Furthermore, the housing of the conventional dust collecting device is opaque, and the user cannot directly observe the condition of the filter material. Therefore, the user must disassemble the housing to know the condition of the filter material. It depends on the filter material which just has accumulated too much nail shavings and nail dust and is severely blocked that the user can remove the dirty filter material and clean it, and then reinstall it in the housing, or replace it with a new one, otherwise, when the filter material only accumulates a small number of nail shavings and remains unblocked, then there is no need to replace the filter material, which makes dismantling the housing unnecessary.

In addition, the gas is blown toward the desktop because the axial fan guides the gas to be discharged downward to the air outlet, which causes the paper on the desktop to be disturbed by the gas, and the nail shavings and nail dust on the desktop is also blown up, which makes the user feel uncomfortable.

Besides, the housing of the conventional dust collecting device is in a square shape, and it is difficult for a user to hold the housing with one hand, and it is difficult to move the dust collecting device.

SUMMARY OF THE INVENTION

The present invention mainly provides a dust collection device with an extendible and flexible air tube, which can directly inhale the nail shavings and nail dust that slowly falling and thrown out during nail polishing, and the dust collection efficiency is more than 50%, which greatly reduces the nail shavings and nail dust thrown around.

The present invention provides another dust collection device with an extendible and flexible air tube, which reduces the occupied space and increases the beauty and texture of the dust collecting device of the present invention.

The present invention provides yet another dust collection device with an extendible and flexible air tube, which can directly monitor the condition of the filter material by different views, and control the cleaning or replacement time of the filter material at any time, thus disassembling the dust collecting device of the present invention is not necessary.

The present invention provides still another dust collection device with an extendible and flexible air tube, which can guide the axially entering gas to be discharged laterally through the air outlet to prevent the gas from being blown to the table.

The present invention further provides another dust collection device with an extendible and flexible air tube, which can allow users to hold directly and easily move the dust collection device of the present invention.

To achieve the objects mentioned above, the present invention provides a dust collecting device with an extendible and flexible air tube including a housing, a cover, an air tube, a dust collecting head, a filter material and a gas guiding device. The housing has an air outlet. The cover is detachably disposed on the housing and has an accommodating groove. The air tube has a first end positioned in the accommodating groove and is extendible and flexible, the air tube is capable of being extended to outside the accommodating groove and retracted to be accommodated in the accommodating groove, and a bending angle and an extension direction of the air tube is changeable by flexibility. The dust collecting head is disposed at a second end of the air tube, and is positioned in the accommodating groove when the air tube is shortened to be accommodated in the accommodating groove. The filter material is disposed inside the housing and close to the cover. The gas guiding device is disposed inside the housing and used to guide the gas sequentially through the dust collecting head, the air tube, inner of the cover and the filter material to the air outlet.

Preferably, the cover is totally or partially transparent.

Preferably, the cover includes a cover portion and a neck portion. A diameter of the cover portion is continuously rounded or smoothed edge from upper to lower section, the bottom end of the cover portion detachably surrounds an outer peripheral edge disposed on the top end of the housing, the neck portion is integrally formed on the top end of the cover portion, and the accommodating groove is formed inside the cover portion.

Preferably, the accommodating groove includes a large diameter portion, a small diameter portion, and a sleeve portion, wherein an opening is disposed on a top end of the large diameter portion, the opening communicates with external space, and the small diameter portion is coaxially disposed at a bottom end of the large diameter portion, an inner diameter of the large diameter portion is greater than an inner diameter of the small diameter portion, the sleeve portion protrudes axially upward from a bottom end of the small diameter portion, and a perforation penetrating through the top end and bottom end of the small diameter portion is opened, the perforation communicates with an interior of the cover, and a first end of the air tube is sleeved on an outside of the sleeve portion and is abutted against the bottom end of the small-diameter portion to be positioned in the accommodating groove and allow an interior of the air tube to communicate with the perforation; wherein when the air tube is shortened to be accommodated in the accommodating groove, the dust collecting head is positioned in the large diameter portion.

Preferably, the air outlet is located beside of the housing, the cover is disposed on the top end of the housing, the filter material is disposed on the top end of the housing and located under the cover, the gas guiding device is a centrifugal fan located under the filter material, gas flows into the gas guiding device axially, the gas is thrown outside of the gas guiding device under centrifugation, and then discharged outward from the air outlet.

Preferably, the housing includes an upper shell and a lower shell, the upper shell and the lower shell are combined with each other and together form a chamber. A groove is recessed on a top end of the upper shell, and a via is formed at a bottom end of the groove, the via communicates with the groove and the chamber, the cover is disposed on the top end of the upper shell, the filter material is disposed in the groove, the gas guiding device is disposed in the chamber, and is located under the via.

Preferably, the dust collecting device further includes a gasket and a plurality of soft cushions, the gasket is disposed between the top end of the gas guiding device and the upper shell, and the soft cushions are respectively disposed between the bottom end of the gas guiding device and the lower shell.

Preferably, the dust collecting device further includes a control module including a circuit board, a power supply unit and a switch; wherein the circuit board is disposed in the housing and electrically connected to the gas guiding device, the power supply unit is disposed in the housing and used to be selectively electrically connected the circuit board, the switch is disposed on an outer surface of the housing and electrically connected to the circuit board; wherein when the switch is turned on, the power supply unit and the circuit board are in a conducting state, the power supply unit can supply power to the circuit board to start the gas guiding device; and wherein when the switch is turned off, the power supply unit and the circuit board are in a disconnected state, the power supply unit stops supplying power to the circuit board to turn off the gas guiding device.

Preferably, the power supply unit includes at least one battery and a power socket. The at least one battery is disposed in the housing, and located under the gas guiding device, and is selectively electrically connected to the circuit board. The power socket is disposed on the outer surface of the housing, selectively electrically connected to the circuit board, and used for a plugging portion of a power cord to be inserted therein.

Preferably, the control module includes a power indicator disposed on the outer surface of the housing, electrically connected to the circuit board, and used to display the power of the at least one battery.

Preferably, the dust collecting device further includes at least one cushion block disposed between the bottom end of the gas guiding device and the top end of the at least one battery.

Preferably, the control module includes a flowrate adjusting member disposed on the outer surface of the housing, electrically connected to the circuit board, and used to adjust a rotational speed of the gas guiding device to control a flowrate of the gas.

Preferably, the dust collecting device further includes a plurality of foot pads respectively disposed at the bottom end of the housing.

Preferably, the dust collecting device further includes a dust cap with a plurality of openings; wherein the dust cap is detachably disposed on the housing after the cap is detached from the housing; and wherein the cap is detachably disposed on the housing after the dust cap is detached from the housing.

The main effect of the present invention is that the dust collecting head can be positioned at a specific position and aligned with the nail at a specific angle and direction because the length, bending angle and extension direction of the air tube can be arbitrarily changed, so that the nail shavings and nail dust that slowly falling and thrown out during nail polishing can be directly inhaled into the housing, and the dust collection efficiency being more than 50% greatly reduces the nail shavings and nail dust thrown around.

Further, when the dust collecting device of the present invention is not used, the air tube can be arbitrarily changed in length, bending angle and extension direction to be shortened to be accommodated in the accommodation groove, and the dust collecting head is positioned in the accommodation groove and thus reducing the occupied space, which can also increase the overall beauty and texture of the dust collection device of the present invention.

In addition, the user can directly see the accumulation of nail shavings and nail dust on the filter material through the cover from any angle because the cover is totally or partially transparent, and control the cleaning or replacement time of the filter material at any time, thus disassembling the dust collecting device of the present invention is not necessary.

In addition, the gas guiding device is a centrifugal fan, which can change the axially entering gas to be discharged laterally through the air outlet to prevent the gas from being blown to the desktop, the papers on the desk are not blown around, and the nail dust is not blown up by the gas at all, which improves the user's comfort.

Besides, the neck portion can allow users to hold directly by one hand and easily move the dust collection device of the present invention.

DETAILED DESCRIPTION OF THE PREFERRED EMBODIMENT

Figure 1:
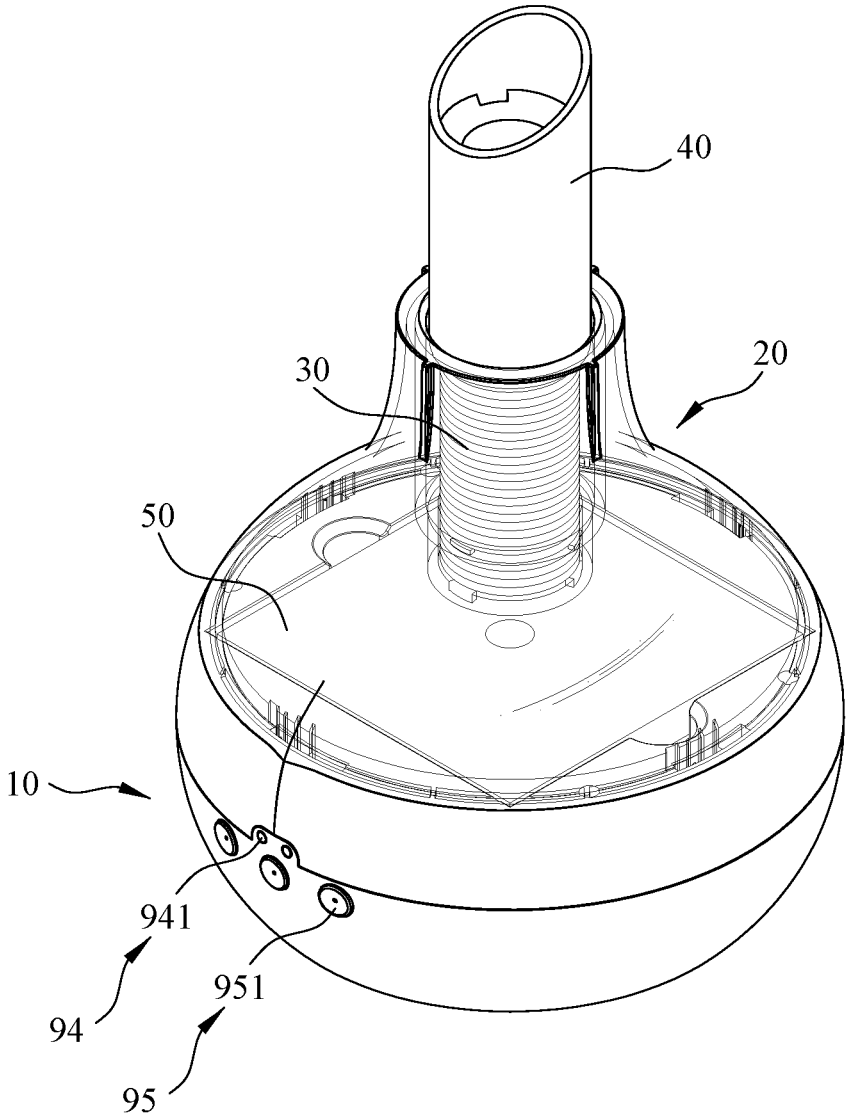
FIG. 1 is a perspective view of the dust collecting device of the present invention.

The following describes the implementation of the present invention in more detail with drawings and element symbols, so that those skilled in the art can implement after studying this specification.

Please refer to FIG. 1 to FIG. 6, which are perspective views, rear side view, bottom view, exploded view, exploded view and sectional view of the main body of the dust collecting device of the present invention. The present invention provides a dust collecting device with an extendible and flexible air tube 30 includes a housing 10, a cover 20, an air tube 30, a dust collecting head 40, a filter material 50, a gas guiding device 60, a gasket 70, a plurality of soft cushions 80, a control module 90, two cushion blocks 100 and four foot pads 110.

Figure 2:
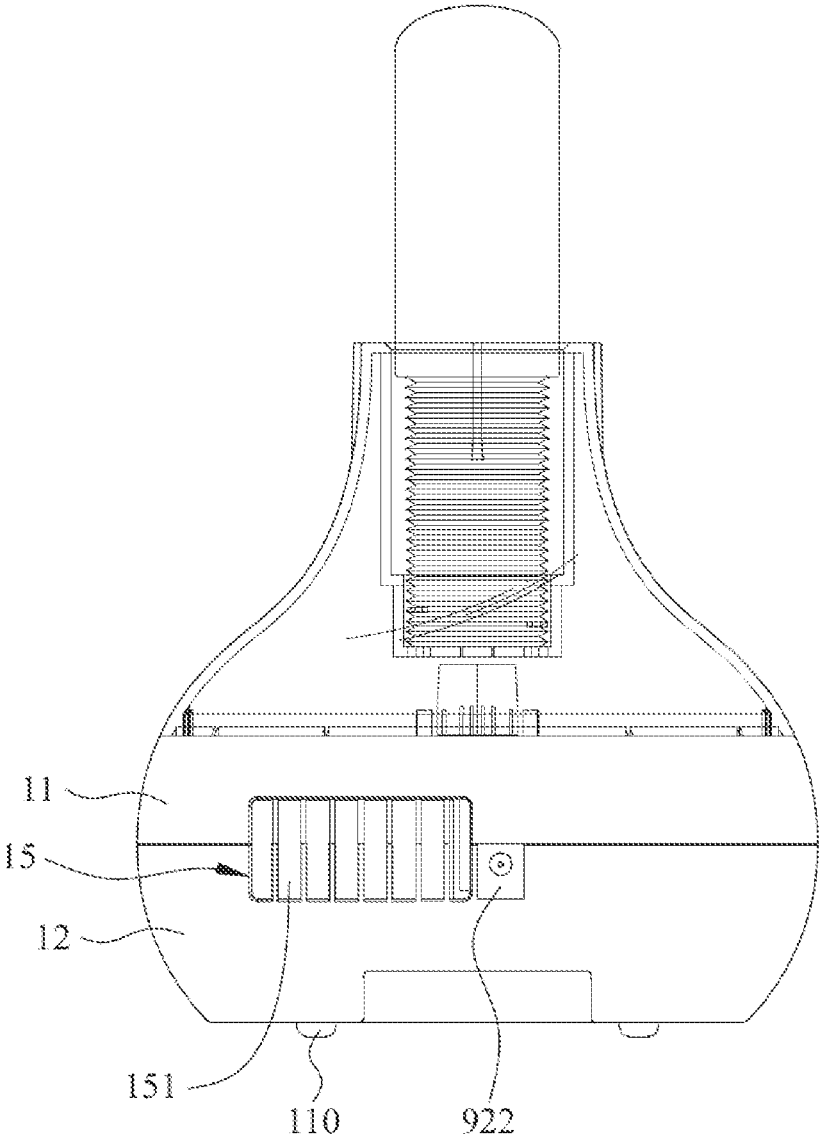
FIG. 2 is a rear side view of the dust collector of the present invention.
Figure 5:
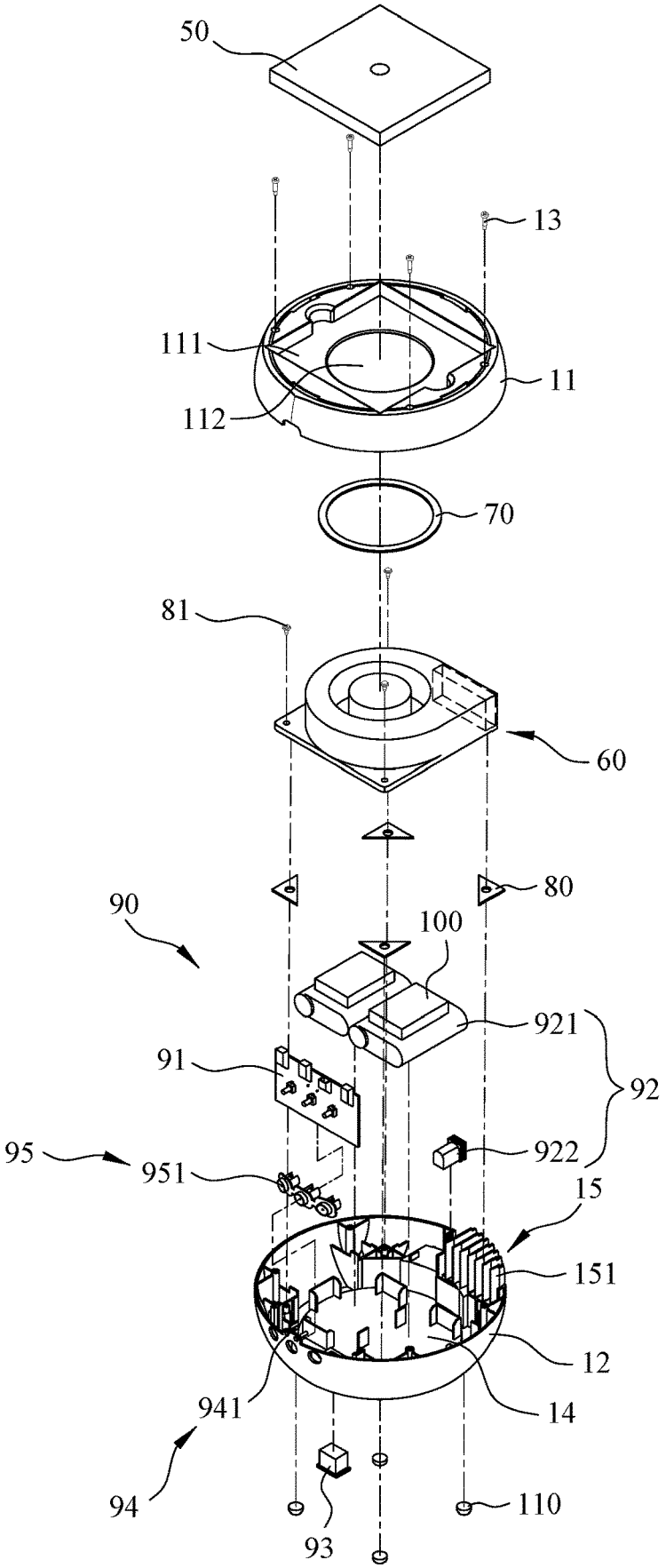
FIG. 5 is an exploded view of a body of the dust collecting device.

The housing 10 is drum-shaped and includes an upper shell 11 and a lower shell 12, the upper shell 11 and the lower shell 12 are fixed to each other by a plurality of fastening components 13, and together form a chamber 14. As shown in FIG. 5, a groove 111 is recessed on the top of the upper shell 11, and a via 112 is opened at the bottom of the groove 111. The via 112 communicates with the groove 111 and the chamber 14. As shown in FIGS. 2 and 5, An air outlet 15 is jointly provided at the junction of the rear sides of the upper shell 11 and the lower shell 12, and a plurality of air deflectors 151 are disposed in the air outlet 15 to control the direction of the gas at the air outlet.

The cover 20 includes a cover portion 21 and a neck portion 22. The cover portion 21 is bowl-shaped, the diameter of the cover portion 21 is continuously rounded or smoothed edge from upper to lower section, and the bottom end of the cover portion 21 detachably surrounds an outer peripheral edge disposed on the top end of the upper shell 11. The neck 22 is tube-shaped, integrally formed on the top end of the cover portion 21, and an accommodating groove 23 is formed inside the cover portion 21. The accommodating groove 23 includes a large diameter portion 231, a small diameter portion 232 and a sleeve portion 233, the large diameter portion 231 extends downward from the top of the neck portion 22 to the inside of the neck portion 22, and an opening 2311 is opened at the top end of the large diameter portion 231, the opening 2311 communicates with the external space, and the small diameter portion 232 is coaxially disposed at the bottom end of the large diameter portion 231, an inner diameter of the large diameter portion 231 is greater than an inner diameter of the small diameter portion 232, the sleeve portion 233 protrudes axially upward from the bottom end of the small diameter portion 232, and a perforation 2331 is formed through the top end and bottom end of the sleeve portion 233, and the perforation 2331 communicates with the inside of the cover portion 21.

In this embodiment, the cover 20 is totally transparent. In other words, the cover portion 21 and the neck portion 22 are both transparent. In other embodiments, the cover 20 may also be partially transparent. For example, the cover portion 21 is totally transparent, and the neck portion 22 is totally opaque. Alternatively, a transparent window is arranged around the cover portion 21 in a circumferential direction, and the neck portion 22 is totally opaque. Alternatively, multiple transparent windows are arranged at intervals on the cover portion 21 in a circumferential direction, and the neck portion 22 is totally opaque.

A first end 31 of the air tube 30 is sleeved outside of the sleeve portion 233, and abuts against the bottom end of the small diameter portion 232, so as to be positioned in the accommodating groove 23, so that the interior of the air tube 30 communicates with the perforation 2331. The air tube 30 is extendible and flexible, and the air tube 30 can be extended outside the accommodating groove 23 (see FIG. 7) or shortened to be accommodated in the accommodating groove 23 (see FIGS. 1, 2, 6) by extendibility, the air tube 30 can arbitrarily change the bending angle and extension direction by flexibility (see FIG. 7).

Figure 6:
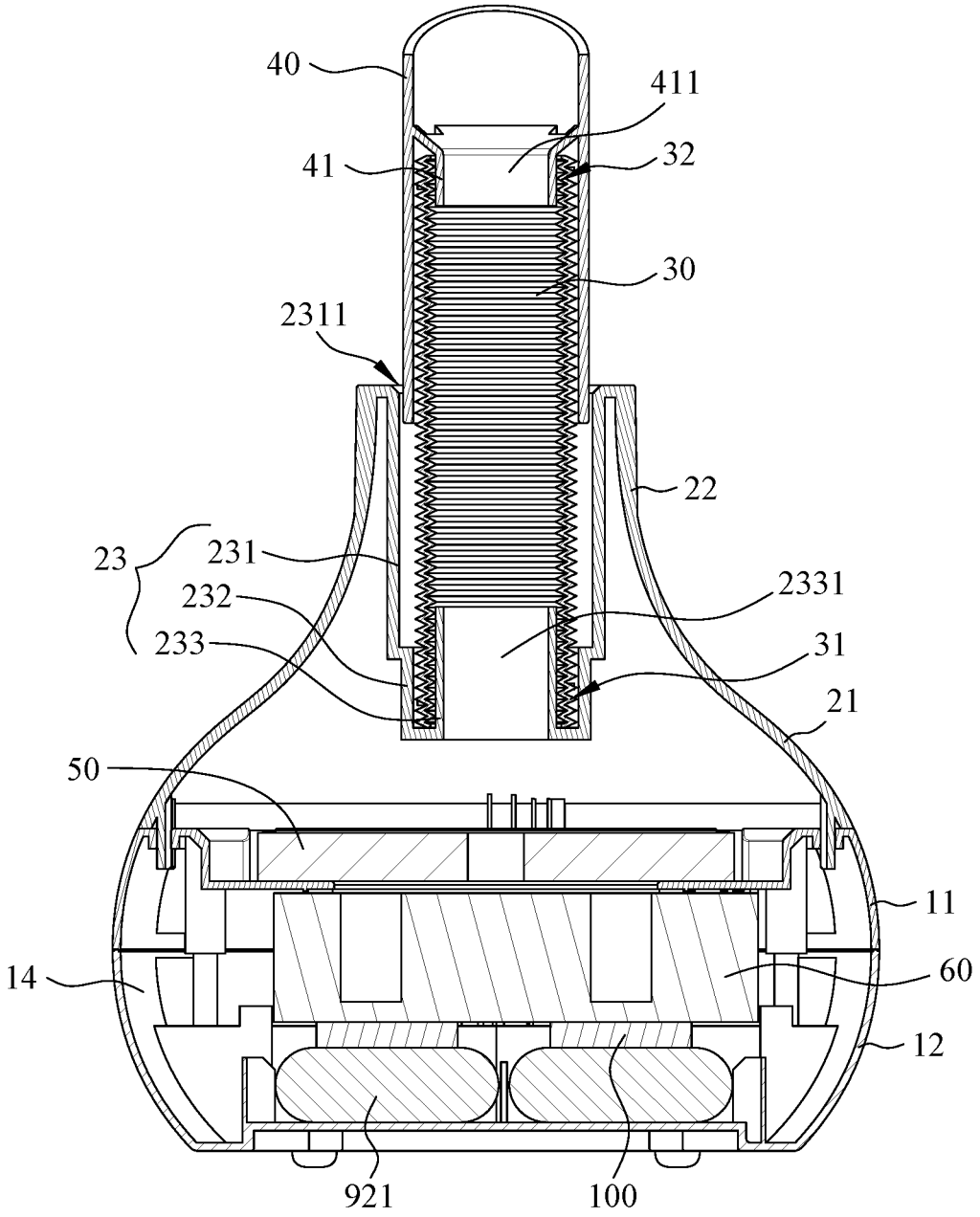
FIG. 6 is a sectional view of the dust collecting device of the present invention.

The dust collecting head 40 is disposed at a second end 32 of the air tube 30. More specifically, as shown in FIG. 6, a through hole 411 is disposed from the top end to the bottom end of the socket portion 41, a second end 32 of the air tube 30 is sleeved on the outside of the socket portion 41, so as to be positioned in the dust collecting head 40, and the inside of the air tube 30 communicates with the through hole 411 of the socket portion 41. When the air tube 30 is shortened to be accommodated in the accommodating groove 23, the dust collecting head 40 is positioned in the large diameter portion 231.

The filter material 50 is disposed in the groove 111, and is located below the cover portion 21. More specifically, the filter material 50 is a filter cotton, and the material of the filter cotton may be any material having the effect of filtering dust particles, such as synthetic fiber, non-woven fabric, glass fiber, activated carbon, etc. However, it is not limited to this, other structures that have the effect of filtering dust particles can be used as the filter material 50, such as a filter screen.

The gas guiding device 60 is a centrifugal fan, which is disposed in the chamber 14 and is located under the via 112. In this embodiment, the gas guiding device 60 is a turbo-type centrifugal fan. In other embodiments, the gas guiding device 60 may also be any type of centrifugal fan such as a multi-wing centrifugal fan, a radial centrifugal fan or a wing-cut centrifugal fan.

The gasket 70 is disposed between the top end of the gas guiding device 60 and the upper shell 11, and the soft cushions 80 are respectively locked between the bottom end of the gas guiding device 60 and the lower shell 12 by a plurality of fastening components 81 to absorb a vibration force generated during the operation of the gas guiding device 60 to prevent the vibration force generated during the operation of the gas guide device 60 from being transmitted to the housing 10, so that the dust collecting device of the present invention dose not vibrate on the desktop.

Figure 3:
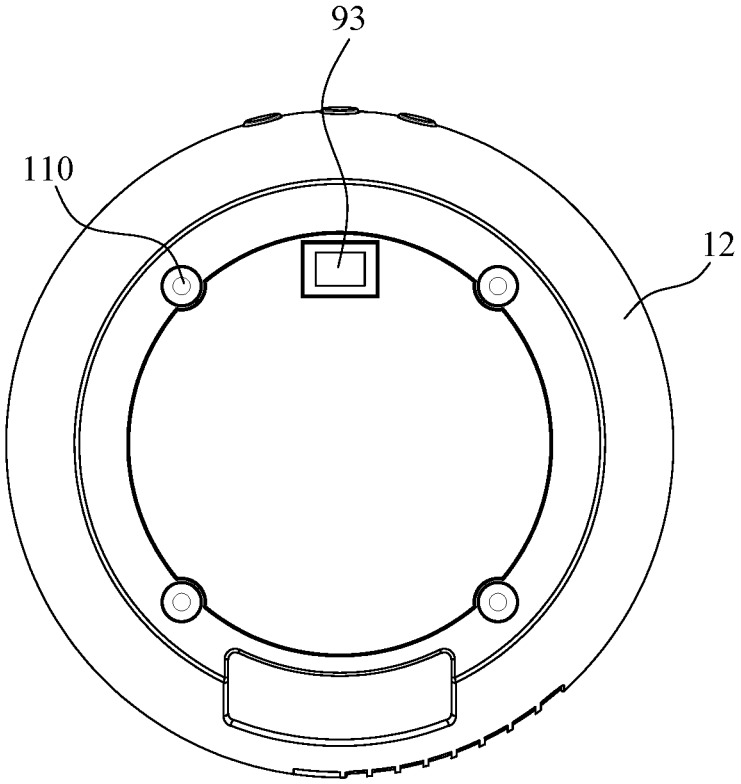
FIG. 3 is a bottom view of the dust collector of the present invention.
Figure 4:
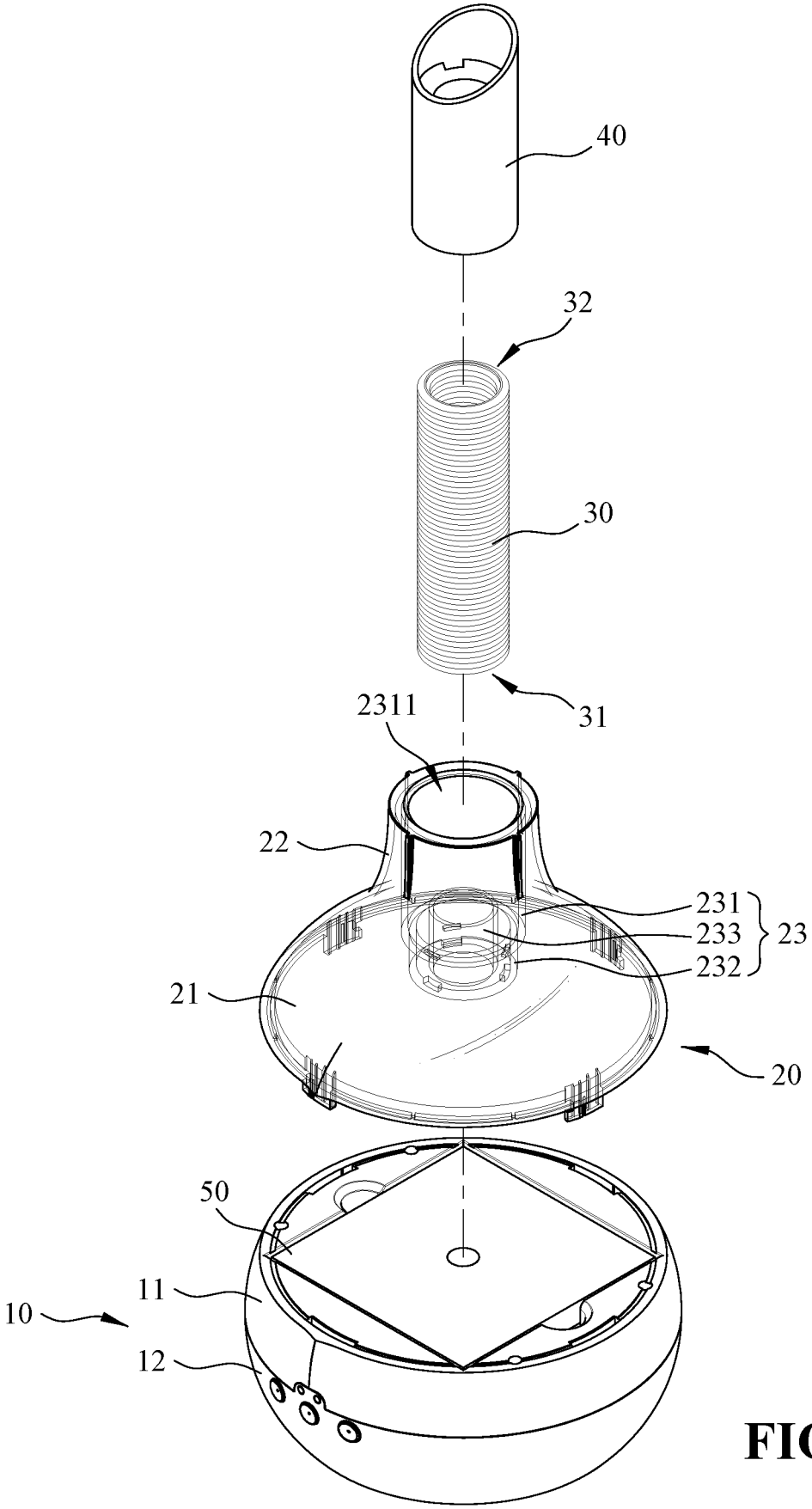
FIG. 4 is an exploded view of the dust collecting device of the present invention.

The control module 90 includes a circuit board 91, a power supply unit 92, a switch 93, a power indicator 94 and a flowrate adjusting member 95. As shown in FIG. 5, the circuit board 91 is disposed in the chamber 14, and electrically connected to the gas guide device 60. As shown in FIG. 2, FIG. 5, and FIG. 6, the power supply unit 92 includes two batteries 921 and a power socket 922. The batteries 921 are disposed in the chamber 14 under the gas guiding the device 60, and selectively electrically connected to the circuit board 91. The power socket 922 is disposed on the outer surface of the rear side of the lower shell 12, selectively electrically connected to the circuit board 91, and used for a socket portion of a power chord (not shown) to be inserted therein. As shown in FIGS. 3 and 5, the switch 93 is disposed on the outer surface of the bottom end of the lower shell 12 and electrically connected to the circuit board 91. As shown in FIG. 1, The power indicator 94 is disposed on the outer surface of the front side of the lower shell 12, and electrically connected to the circuit board 91, and used to display the power of the batteries 921. Preferably, the power indicator 94 includes two light guiding pillars 941, which light is used to show the power of the batteries 921. As shown in FIG. 1, FIG. 4, and FIG. 5, the flowrate adjusting member 95 is disposed on the outer surface of the front side of the lower shell 12 under the power display members 94, electrically connected to the circuit board 91, and used to adjust the rotation speed of the gas guiding device 60 to control the flowrate of the gas. In this embodiment, the flowrate adjusting member 95 includes a plurality of buttons 951. In other embodiments, the flowrate adjusting member 95 may also include a plurality of knobs or a touch panel. In these embodiments, pressing the buttons 951 or rotating the knobs or pressing the touch panel to adjust the rotation speed of the gas guide 60 to control the flowrate of the gas.

The cushion blocks 100 are respectively disposed between the bottom end of the gas guiding device 60 and the top end of the batteries 921, so as to absorb the vibration force during the operation of the gas guiding device 60 and avoid the vibration force generated during the operation of the gas guiding device 60 from being transmitted to the batteries 921. Preferably, the material of each cushion block 100 is foam.

The foot pads 110 are respectively disposed at the bottom end of the lower shell 12, so as to improve the stability of the dust collecting device of the present invention.

Figure 7:
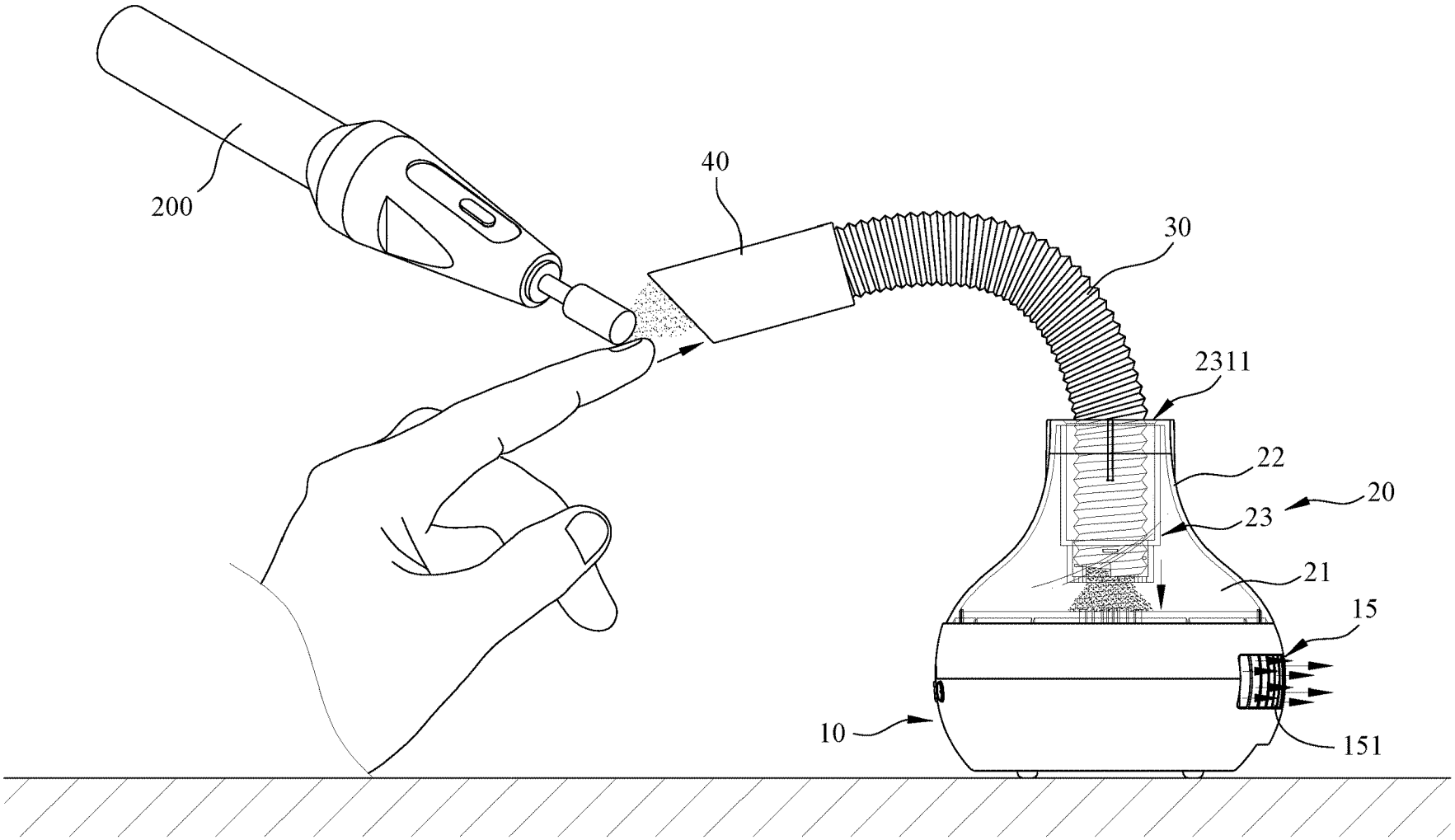
FIG. 7 is a schematic diagram of the dust collecting device of the present invention collecting nail shavings and nail dust.

Please refer to FIG. 7. FIG. 7 is a schematic diagram of collecting nail shavings and nail dust for the dust collecting device of the present invention. First, the user may place the dust collecting device of the present invention on a desktop. Next, the user may use one hand to hold the dust collecting head 40 and pull out the dust collecting head 40 from the large diameter portion 231. At this time, the air tube 30 can be extended through the opening 2311 of the large diameter portion 231 to extend out of the accommodating groove 23 by extendibility. At the same time, the bending angle and extension direction of the air tube 30 can be arbitrarily changed by extendibility, so that the dust collecting head 40 is positioned at a specific position and the nails are aligned at a specific angle and a specific direction. Finally, a nail polisher 200 is used to polish the nails and the switch 93 is pressed simultaneously. When the switch 93 is turned on, the batteries 921 and the circuit board 91 are in a conducting state, and the batteries 921 can supply power to the circuit board 91 to start the gas guiding device 60. Alternatively, the power socket 922 and the circuit board 91 are in the conducting state, a plug (not shown) of the power cord is inserted into a socket (not shown) that provides commercial power, the socket portion of the power cord is inserted into the power socket 922, the combination of the power cord and the power socket 922 can supply power to the circuit board 91, so as to start the gas guiding device 60. The gas guiding device 60 guides the gas sequentially through the dust collecting head 40, the air tube 30, the perforation 2331 of the sleeve portion 233, the inside of the cover portion 21, the filter material 50, the via 112, and then guides the gas to flow into the gas guiding device 60 in the axial direction. Under the centrifugation, the gas is thrown out of the gas guide device 60 and then discharged outward from the air outlet 15. During the process of nail polishing, the nail shavings and nail dust from the nail follows the gas sequentially through the dust collecting head 40, the air tube 30, the perforation 2331 of the sleeve portion 233, the inside of the cover portion 21, and then be blocked by the filter material 50 and concentrated on the surface of the filter material 50 to achieve the effect of collecting nail shavings and nail dust.

When the switch 93 is turned off, the batteries 921 or the power socket 922 and the circuit board 91 are in a disconnected state, and the combination of the batteries 921 or the power socket 922 and the power cord stops supplying power to the circuit board 91, so as to turn off the gas guiding device 60, and the dust collecting device of the present invention thus stops collecting nail shavings and nail dust.

The dust collecting head 40 can be positioned at a specific position and aligned with the nail (such as the top end or sides of the nail) at a specific angle and direction because the length, bending angle and extension direction of the air tube 30 can be arbitrarily changed, so that the nail shavings and nail dust that slowly falling and thrown out during nail polishing can be directly inhaled into the housing 10, and the dust collection efficiency being more than 50% greatly reduces the nail shavings and nail dust thrown around.

Further, when the dust collecting device of the present invention is not used, the air tube 30 can be arbitrarily changed in length, bending angle and extension direction to be shortened to be accommodated in the accommodation groove 23, and the dust collecting head 40 is positioned in the large diameter portion 231 and thus reducing the occupied space, which can also increase the overall beauty and texture of the dust collection device of the present invention.

In addition, the user can directly see the accumulation of nail shavings and nail dust on the filter material 50 through the cover 20 from any angle because the cover 20 is totally or partially transparent, and control the cleaning or replacement time of the filter material 50 at any time, thus disassembling the dust collecting device of the present invention is not necessary at all. In fact, as long as the cover portion 21 is totally transparent, or a transparent window is arranged around the cover portion 21 in a circumferential direction, or multiple transparent windows are arranged at intervals on the cover portion 21 along the circumferential direction the above effects can be achieved.

When the user observes through the cover 20 that the filter material 50 needs to be cleaned or replaced, the user can detach the cover 20, remove the dirty filter material 50 from the groove 111, and wash and place the dirty filter material 50 in the groove 111, or a new filter material 50 is placed in the groove 111, and finally the cover 20 is installed on the housing 10, and the cleaning or replacing the filter material 50 can be completed.

In addition, the gas guiding device 60 is a centrifugal fan, which can change the axially entering gas to be discharged laterally through the air outlet 15 to prevent the gas from being blown to the desktop, the papers on the desk is not blown around and the nail dust is not blown up by the gas at all, which improves the user's comfort.

In addition, the dust collecting device of the present invention provides power supply methods such as battery 921 and power outlet 922, so that users can choose the appropriate power supply method according to requirement. For example, if users need to facilitate the movement of the present invention on the desktop or carry the dust collecting device of the present invention, the battery 921 is usually chosen for power supply because the battery 921 does not require a power cord to supply power.

Furthermore, the housing 10 is drum-shaped, the cover portion 21 is bowl-shaped, and the neck portion 22 is tube-shaped, so that the overall appearance of the housing 10 and the cover 20 is similar to a bottle, which can not only improve the dust collection of the present invention but also the appearance and texture of the device, the neck portion 22 can also be directly held by the user with one hand, which is convenient for moving the dust collecting device of the present invention.

Figure 8:
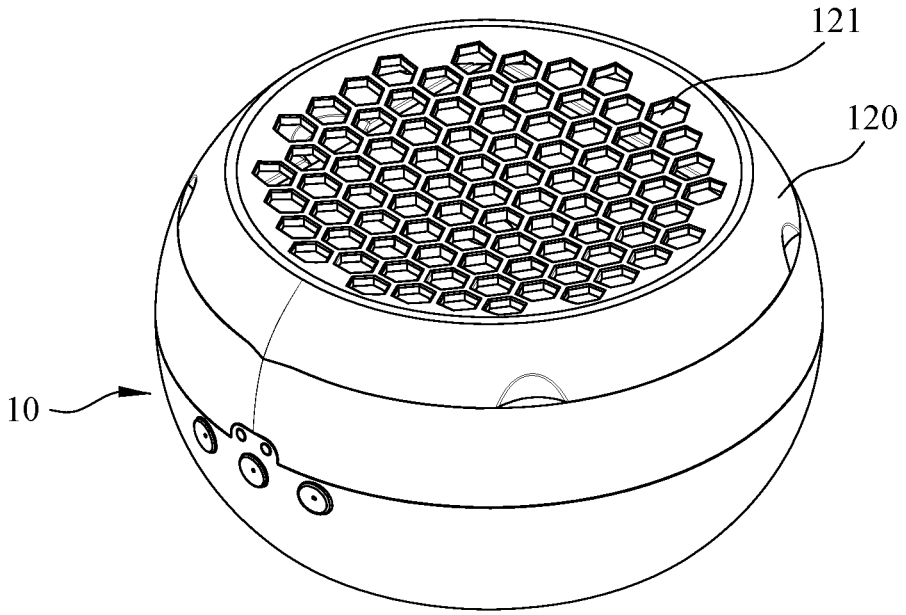
FIG. 8 is a perspective view of the dust cover of the dust collecting device, which is in place of the cover body.
Figure 9:
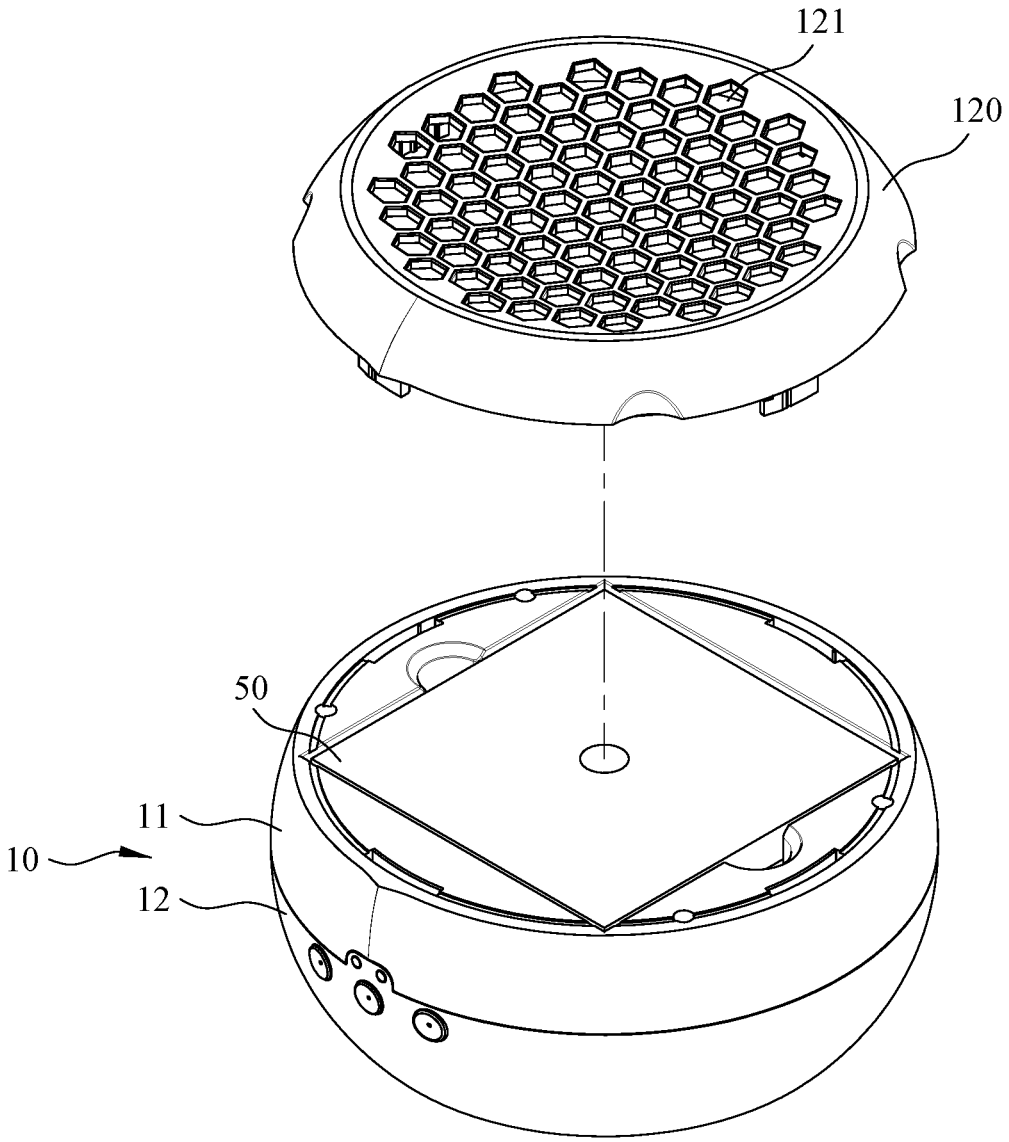
FIG. 9 is an exploded view of the dust cover of the dust collecting device, which is in place of the cover body.

Please refer to FIG. 8 and FIG. 9, which are a perspective view and an exploded view of the dust cap 120 replacing the cover 20 of the dust collecting device of the present invention. The dust collecting device of the present invention further includes a dust cap 120, and the dust cap 120 is opened with a plurality of openings 121. After the cover 20 is separated from the housing 10, the dust cap 120 is detachably disposed on the housing 10. More specifically, since the cover 20 is detachable, the cover 20 can be replaced with the dust cap 120, so that the dust collecting device of the present invention can be converted into a flat dust collecting device. The shape of each opening 121 can be a hexagon as shown in FIG. 8, or other geometric shapes.

Figure 10:
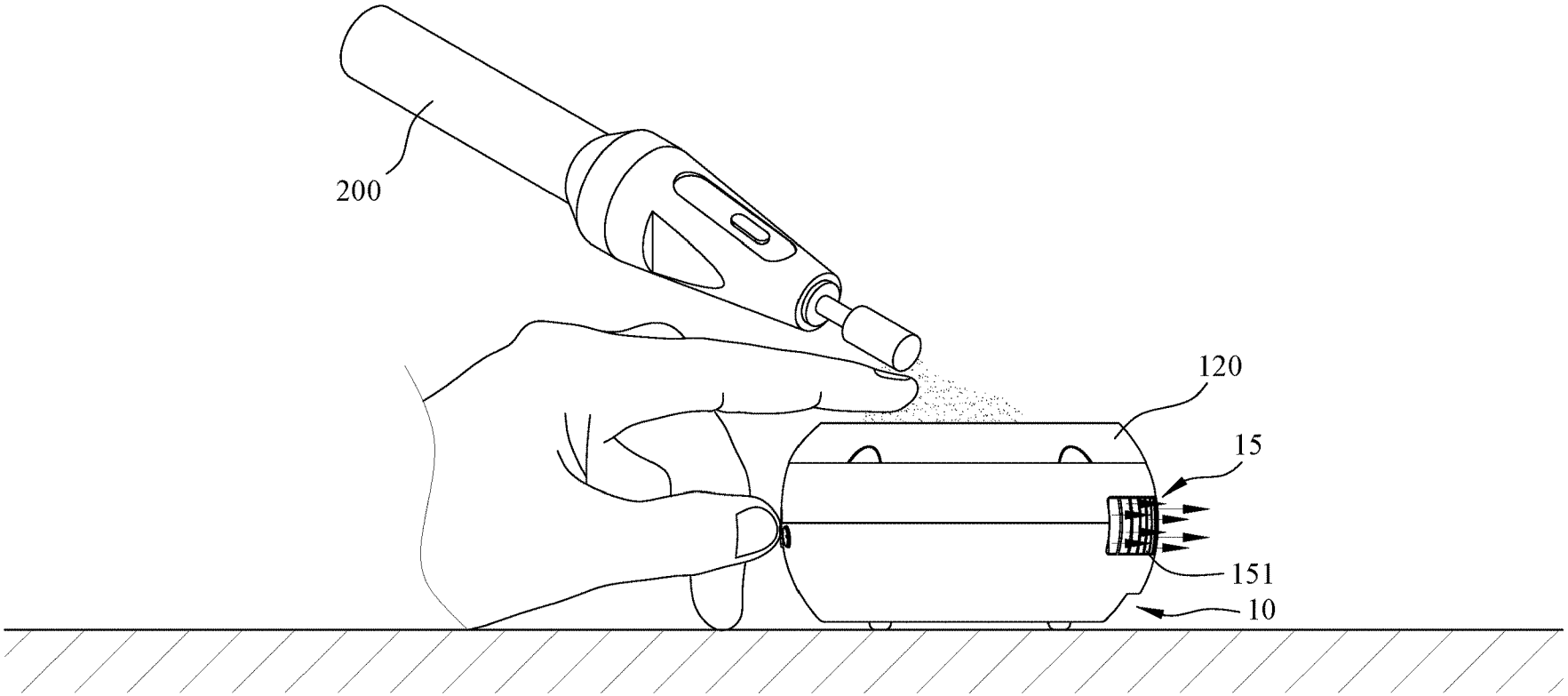
FIG. 10 is a schematic diagram of the dust cover of the dust collecting device of the present invention, which is in place of the cover to collect nail shavings and nail dust.

Please refer to FIG. 10. FIG. 10 is a schematic diagram of dust cap 120 for collecting dust and nail dust instead of cover 20 of the dust collecting device of the invention. The nails are located above the dust cap 120, and the nails are polished by the nail polisher 200. the switch 93 is pressed simultaneously to start the gas guiding device 60. During the process of polishing the nails, nail shavings and nail dust that are ground from the nails pass through the openings 121 and the cover 21 with the gas, and then be blocked by the filter material 50 and concentrated on the surface of the filter material 50 to achieve the effect of collecting nail shavings and nail dust.

The above description is only for explaining the preferred embodiment of the invention, and is not intended to limit the invention in any form, so that any modification or variation of the present invention made in the same spirit should still be included in the scope of the present intention.

What is claimed is:

1. A dust collecting device with an extendible and flexible air tube comprising:

a housing having an air outlet;

a cover detachably disposed on the housing and having an accommodating groove;

an air tube having a first end positioned in the accommodating groove, and being extendible and flexible, wherein the air tube is capable of being extended to outside the accommodating groove and retracted to be accommodated in the accommodating groove, and a bending angle and an extension direction of the air tube is changeable by flexibility;

a dust collecting head disposed at a second end of the air tube, and being positioned in the accommodating groove when the air tube is shortened to be accommodated in the accommodating groove;

a filter material disposed inside the housing and being close to the cover; and a gas guiding device disposed inside the housing, and used to guide the gas sequentially through the dust collecting head, the air tube, inside of the cover and the filter material and then discharged outward from the air outlet;

wherein the accommodating groove includes a large diameter portion, a small diameter portion, and a sleeve portion, wherein an opening is disposed on a top end of the large diameter portion, the opening communicates with external space, and the small diameter portion is coaxially disposed at a bottom end of the large diameter portion, an inner diameter of the large diameter portion is greater than an inner diameter of the small diameter portion, the sleeve portion protrudes axially upward from a bottom end of the small diameter portion, and a perforation penetrating through the top end and bottom end of the small diameter portion is opened, the perforation communicates with an interior of the cover, and a first end of the air tube is sleeved on an outside of the sleeve portion and is abutted against the bottom end of the small-diameter portion to be positioned in the accommodating groove and allow an interior of the air tube to communicate with the perforation; wherein when the air tube is shortened to be accommodated in the accommodating groove, the dust collecting head is positioned in the large diameter portion.

2. The dust collecting device of claim 1, wherein the cover is totally or partially transparent.

3. The dust collecting device of claim 2, wherein the cover includes a cover portion and a neck portion, and a diameter of the cover portion is continuously rounded or smoothed edge from upper to lower section, the bottom end of the cover portion detachably surrounds an outer peripheral edge disposed on the top end of the housing, the neck portion is integrally formed on the top end of the cover portion, and the accommodating groove is formed inside the cover portion.

4. The dust collecting device of claim 1, wherein the cover includes a cover portion and a neck portion, and a diameter of the cover portion is continuously rounded or smoothed edge from upper to lower section, the bottom end of the cover portion detachably surrounds an outer peripheral edge disposed on the top end of the housing, the neck portion is integrally formed on the top end of the cover portion, and the accommodating groove is formed inside the cover portion.

5. The dust collecting device of claim 1, wherein the air outlet is located beside of the housing, the cover is disposed on the top end of the housing, the filter material is disposed on the top end of the housing and located under the cover, the gas guiding device is a centrifugal fan located under the filter material, a gas flows into the gas guiding device axially, the gas is thrown outside of the gas guiding device under centrifugation, and then discharged outward from the air outlet.

6. The dust collecting device of claim 1, wherein the housing includes an upper shell and a lower shell, the upper shell and the lower shell are combined with each other and together form a chamber, a groove is recessed on a top end of the upper shell, and a via is formed at a bottom end of the groove, the via communicates with the groove and the chamber, the cover is disposed on the top end of the upper shell, the filter material is disposed in the groove, the gas guiding device is disposed in the chamber, and is located under the via.

7. The dust collecting device of claim 6, further comprising a gasket and a plurality of soft cushions, the gasket is disposed between the top end of the gas guiding device and the upper shell, and the soft cushions are respectively disposed between the bottom end of the gas guiding device and the lower shell.

8. The dust collecting device of claim 1, further comprising a control module including a circuit board, a power supply unit and a switch; wherein the circuit board is disposed in the housing and electrically connected to the gas guiding device, the power supply unit is disposed in the housing and used to be selectively electrically connected the circuit board, the switch is disposed on an outer surface of the housing and electrically connected to the circuit board; wherein when the switch is turned on, the power supply unit and the circuit board are in a conducting state, the power supply unit can supply power to the circuit board to start the gas guiding device; and wherein when the switch is turned off, the power supply unit and the circuit board are in a disconnected state, the power supply unit stops supplying power to the circuit board to turn off the gas guiding device.

9. The dust collecting device of claim 8, wherein the power supply unit includes at least one battery and a power socket, the at least one battery is disposed in the housing, and located under the gas guiding device, and is selectively electrically connected to the circuit board, the power socket is disposed on the outer surface of the housing, selectively electrically connected to the circuit board, and used for a plugging portion of a power cord to be inserted therein.

10. The dust collecting device of claim 9, wherein the control module includes a power indicator disposed on the outer surface of the housing, electrically connected to the circuit board, and used to display a power of the at least one battery.

11. The dust collecting device of claim 9, further comprising at least one cushion block disposed between the bottom end of the gas guiding device and the top end of the at least one battery.

12. The dust collecting device of claim 8, wherein the control module includes a flowrate adjusting member disposed on the outer surface of the housing, electrically connected to the circuit board, and used to adjust a rotational speed of the gas guiding device to control a flowrate of the gas.

13. The dust collecting device of claim 1, further comprising a plurality of foot pads respectively disposed at the bottom end of the housing.

14. The dust collecting device of claim 1, further comprising a dust cap with a plurality of openings; wherein the dust cap is configured to be detachably disposed on the housing after the cap is detached from the housing; and wherein the cap is configured to be detachably disposed on the housing after the dust cap is detached from the housing.

* * * * *